US006551200B1

(12) United States Patent
Golden et al.

(10) Patent No.: US 6,551,200 B1
(45) Date of Patent: Apr. 22, 2003

(54) GOLF CLUB HEAD

(75) Inventors: Charles Golden, Del Mar, CA (US); Bret Wahl, Carlsbad, CA (US); David Anderson, San Diego, CA (US); Benoit Vincent, Leucadia, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 10/057,293

(22) Filed: Oct. 19, 2001

(51) Int. Cl.[7] ..... A63B 53/04
(52) U.S. Cl. ..... 473/349; 473/350
(58) Field of Search ..... 473/290, 291, 473/324, 334, 335, 336, 337, 338, 339, 349, 350, 345, 256, 292; D21/747, 748, 749, 753, 759

(56) References Cited

U.S. PATENT DOCUMENTS

| | | | | |
|---|---|---|---|---|
| D164,597 | S | | 9/1951 | Penna |
| 4,883,275 | A | | 11/1989 | Boone |
| 5,048,835 | A | * | 9/1991 | Gorman |
| 5,401,021 | A | * | 3/1995 | Allen |
| D389,540 | S | | 1/1998 | Mendenhall |
| 5,816,936 | A | * | 10/1998 | Aizawa |
| 5,879,242 | A | | 3/1999 | Mendenhall |
| 6,482,104 | B1 | * | 11/2002 | Gilbert |

OTHER PUBLICATIONS

Mizuno, '92 Golf Equipment Guide, p. 40.
Daiwa, Daiwa Imagination '93, p. 25.
93 Clubmaking Catalog, Genesis II Irons, p. 34.
Edwin Watts Golf, Spring 2001, p. 72.
Wilson, Mark, The Golfworks, The Golf Club Identification and Price Guide II, pp. 6–1, 9–21.

* cited by examiner

*Primary Examiner*—Sebastiano Passaniti
(74) *Attorney, Agent, or Firm*—Sheppard, Mullin, Richter & Hampton LLP; James R. Brueggemann

(57) ABSTRACT

A golf club head is provided having enhanced flexibility for launching a golf ball and is most advantageous for use in a wedge-type golf club. An upper portion of the body of the golf club head has a reduced stiffness while a lower portion of the body has reduced stiffness recesses located toward the heel and toe. A low central region supports the head at impact with the golf ball. The relative stiffness in the lower portion of the club head, varying from heel to toe, combines with a top to bottom difference in stiffness to provide enhanced flexibility and selectively increased stiffness for improved performance and feel.

23 Claims, 6 Drawing Sheets

GOLF CLUB HEAD

BACKGROUND OF THE INVENTION

The present invention relates generally to golf clubs and, more particularly, to the heads of iron-type golf clubs.

Among the varied clubs that a golfer must master, or at least become competent in using, are so-called short irons. A special category of short irons are wedges. The types of wedges a golfer may have in his or her bag include an approach, pitching, sand, and/or lob wedge. Each type of wedge has a range of loft angles associated with it, ranging overall from about 45 degrees to about 61 degrees. This provides in a high launch angle, with the golf ball typically obtaining a high spin rate.

A wedge is used to hit the ball onto the green from a location relatively close to the green, and sometimes from a sand bunker. The use of a wedge may entail a modified swing by the golfer, unless a full fairway shot requiring a normal, full swing is appropriate for the distance to the green. A significant design element in these wedges is the particular scoreline pattern on the front striking face of the club head, which is used to produce high spin rates.

One conventional design for a wedge-type golf club head includes an upper part that has a constant thickness, i.e., like a blade, and a lower part that is uniformly triangular in cross-section at the rear of the head. This provides a relatively low mass concentration, which combines with the high loft angle to aid the golfer in getting the club head under the golf ball, particularly in sand or tall, rough grass areas. The overall mass distribution results in a hard feeling upon contact with a golf ball that is unpleasant to many golfers. Generally, it is desirable for wedges to have a "soft" feel so that the golfer has feedback on the appropriate swing and contact with the ball in order to achieve the desired ball travel distance.

Other wedge designs remove some mass from the rear of the head at the toe area and another amount of mass from the heel area, to create two pockets or recesses. This forms a central bar at the rear of the club head. In one such design, the toe and heel end masses and the central bar extend to an upper position, toward the topline, at the rear of the club head. The increase in thickness of the central bar relative to the upper part of the club head is limited in order not to substantially increase the head's weight. Another such wedge design has minimal amounts of mass removed from the toe and/or heel areas, so as to form a more cosmetic feature that does not differ substantially from the previous, conventional design. In both recess designs, a higher positioned mass at the rear tends to stiffen the club head.

Yet another such wedge recess design includes a high central bar at the rear of the club head coupled with a very low mass concentrated substantially horizontally above the sole of the club head. The central bar is used to add mass at a point of impact, and extends to nearly the top edge. Again, in order to minimize added mass, the central bar is not substantially thicker than the upper part of the club head. This design also tends to undesirably stiffen the impact area of the face and allows undesirable lateral vibration of the club head.

A somewhat opposite wedge design includes a U-shaped rib at the rear of the club head that extends from the heel end to the toe end. The rib eliminates the central bar and includes toe and heel masses that extend to nearly the top edge of the club head. However, the golf ball impacts a thinner club face at the center portion and, as a result, the club head may not impart the desired initial velocity or spin rate to the golf ball and may also produce an unpleasant feeling or vibration to the golfer.

SUMMARY OF THE INVENTION

The present invention provides an iron-type golf club head that has enhanced flexibility and selectively increased stiffness for improved performance and feel. The club head provides relative stiffness in a lower portion of the head, varying from heel to toe, combined with a reduced stiffness in an upper portion of the head, to provide improved vibration characteristics.

More particularly, the golf club head of the invention has a body having a planar upper portion and a rearwardly extending lower portion, the upper portion having a top edge and a substantially constant thickness, and the lower portion having a bottom edge. A front surface of the lower portion and a front surface of the upper portion together form a substantially planar striking face having a loft angle measured from a vertical axis. A rear side of the lower portion has at least a first recess adjacent to a toe end and at least a second recess adjacent to a heel end. A lateral axis at the junction of the upper and lower portions of the body extends from the toe end to the heel end, with a reference point being defined at a mid portion of the lateral axis, between about 50% and about 75% of the height of the striking face, measured from the bottom edge to the top edge. This reference point is located less than about 70% of the face height if the loft angle is less than about 56 degrees. A central axis is defined substantially parallel to the lateral axis, at approximately 50% of the face height.

Further, the first recess has a first volume and the second recess has a second volume, both recesses extending downwardly at least to the central axis. The portions of the body that define the first and second recesses each have a stiffness approximately the same as the stiffness of the upper portion, while the remainder of the lower portion has a stiffness at least 50% greater than the stiffness of the upper portion. A central region of the lower portion, located below the reference point, has a maximum stiffness that is at least about 20 times the stiffness of the upper portion. Regions located below the first and second recesses each have a maximum stiffness at least about 10 times the stiffness of the upper portion. A stiffness zone is located within the central region, at the central axis and extending halfway toward the lateral axis, between the first and second recesses, at least about 10% of the length of the striking face. A relative stiffness thereby is established between the central region and the upper portion and between the central region and the first and second recesses.

Other features and advantages of the invention should become apparent from the following description of the preferred embodiments, taken in conjunction with the accompanying drawings, which illustrate, by way of example, the principles of the invention.

DETAILED DESCRIPTION OF THE PREFERRED EMBODIMENTS

The drawings depict several preferred embodiments of a golf club head in accordance with the present invention. With reference to FIGS. 1 to 5, a wedge-type club head 10 in a first preferred embodiment has a body having a top edge and a bottom edge at the front. A scoreline pattern at a striking face of a front wall may comprise U-shaped grooves or any other groove shape desired to obtain a preferred spin rate for a golf ball (not shown) at impact with the striking face. A length of the face LF is measured from a point of intersection of the shaft axis with a plane supporting the club head to the widest point at the toe end of the club head.

Figure 2:
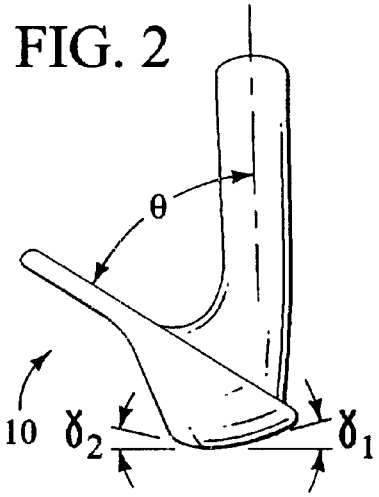
FIG. 2 is a side elevational view of the golf club head of FIG. 1, as viewed from the toe end.
Figure 1:
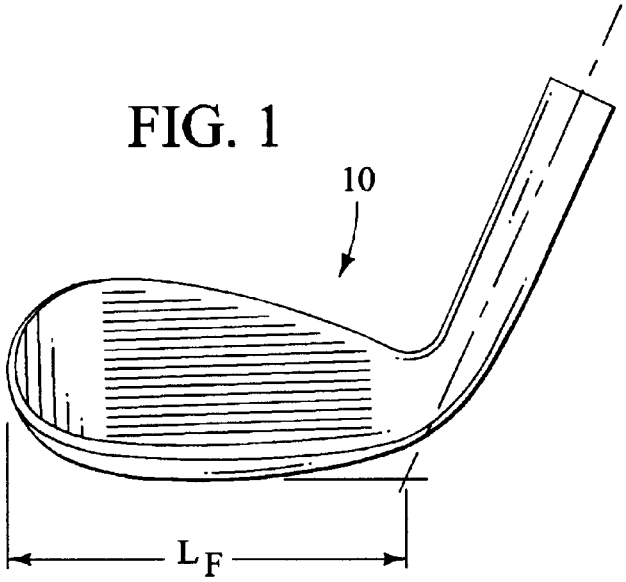
FIG. 1 is a front elevational view of a wedge-type golf club head of a first preferred embodiment, having a striking face with scorelines.

As shown in FIG. 2, the club head 10 has a loft angle θ corresponding to a wedge-type iron. Although the loft angle θ shown is greater than 45 degrees, it is understood that the present invention may be applied to long and mid irons having loft angles from about 20 to 35 degrees and short irons having loft angles up to about 41 degrees, as well as to wedges having loft angles up to about 61 degrees. The sole may have one, two, or more bounce angles $\gamma_i$, as desired, to aid in ground clearance during a stroke.

Figure 4:
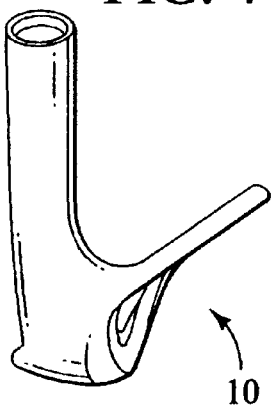
FIG. 4 is a side elevational view of the golf club head of FIG. 1, as viewed from the heel end.
Figure 3:
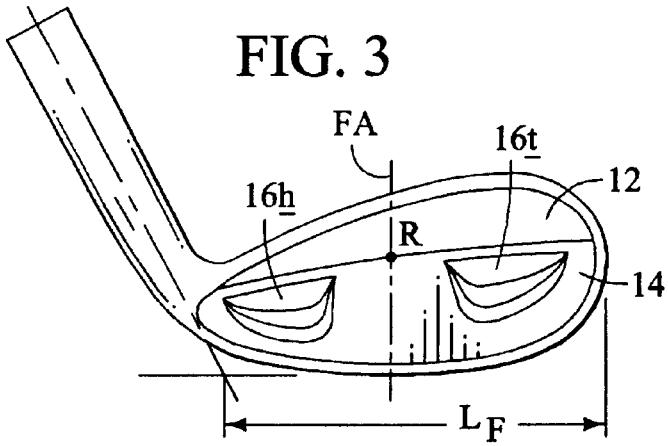
FIG. 3 is a rear elevational view of the golf club head of FIG. 1.

FIGS. 3 and 4 more clearly show how the flexibility of the club head can be enhanced by providing a thin upper portion 12 in combination with a thicker lower portion 14 having recesses 16*t* and 16*h* positioned to opposite sides of a central region. Generally, the rear mass of the club head is specifically located to obtain discrete stiffened portions across the toe, central and heel regions. In the golf club head embodiment of FIGS. 1–5, the discrete stiffness values are achieved using specific thickened portions. In contrast, the previously discussed conventional wedge design has an upper part that is relatively thicker than the upper portion of this preferred embodiment.

A face axis FA is formed at the middle of the central region, within about 10–15% of the midpoint of the length of the face LF. The region of the face axis FA generally corresponds to the club head's "sweet spot." As shown in the plan view of FIG. 5, the club head 10 forms a lateral axis LA that is substantially tangent to—or linearly overlaid with—the junction of the club head's upper portion 12 and lower portion 14. That junction is shown to curve downwardly, but may alternatively curve upwardly or form a straight line. A reference point R is formed at the crossing of the face axis FA with the lateral axis LA.

A reference face height FH is measured at the face axis FA, from the club head's bottom edge to its top edge, parallel to the plane formed by the front striking face. A central axis CA is formed at the middle of the face height FH, parallel to the lateral axis LA. The reference point R should be between about 50% and about 75% of the face height FH. Preferably, the reference point R is located no higher than about 70% of the face height FH, for loft angles up to about 56 degrees, but may extend up to about 75% of the face height FH for wedges with larger loft angles. Table I includes values for a set of wedges of the first preferred embodiment.

TABLE I

First Preferred Embodiment Loft vs. R Values

| | Wedge A | Wedge B | Wedge C | Wedge D | Wedge E |
|---|---|---|---|---|---|
| Loft (degrees) | 52 | 54 | 56 | 58 | 60 |
| Height of R (% FH) | 64 | 65 | 67 | 73 | 72 |

The recesses 16*t* and 16*h* as described herein provide significantly improved flexibility in the club head's toe and heel regions by their specific location and size at the rear of the club head 10. A top end of the central region desirably is limited in lateral extent $l_e$ toward the club head's toe and heel ends, measured along the lateral axis LA, and preferably is about 5–45% of the face length LF, or more preferably about 20–40% of LF. The toe and heel recesses are separated by the central region. The recesses preferably are bound laterally at the toe and heel ends by ribs that extend beneath the recesses, above the sole. The upper ends of the ribs may lie generally along the lateral axis LA or, alternatively, one or both of the upper ends may lie below or above the lateral axis LA. Preferably, neither rib extends beyond 80% of the face height FH at the toe and heel ends, and both ribs have heights measured above the sole that are at least 10% of the face height FH.

Figure 5:
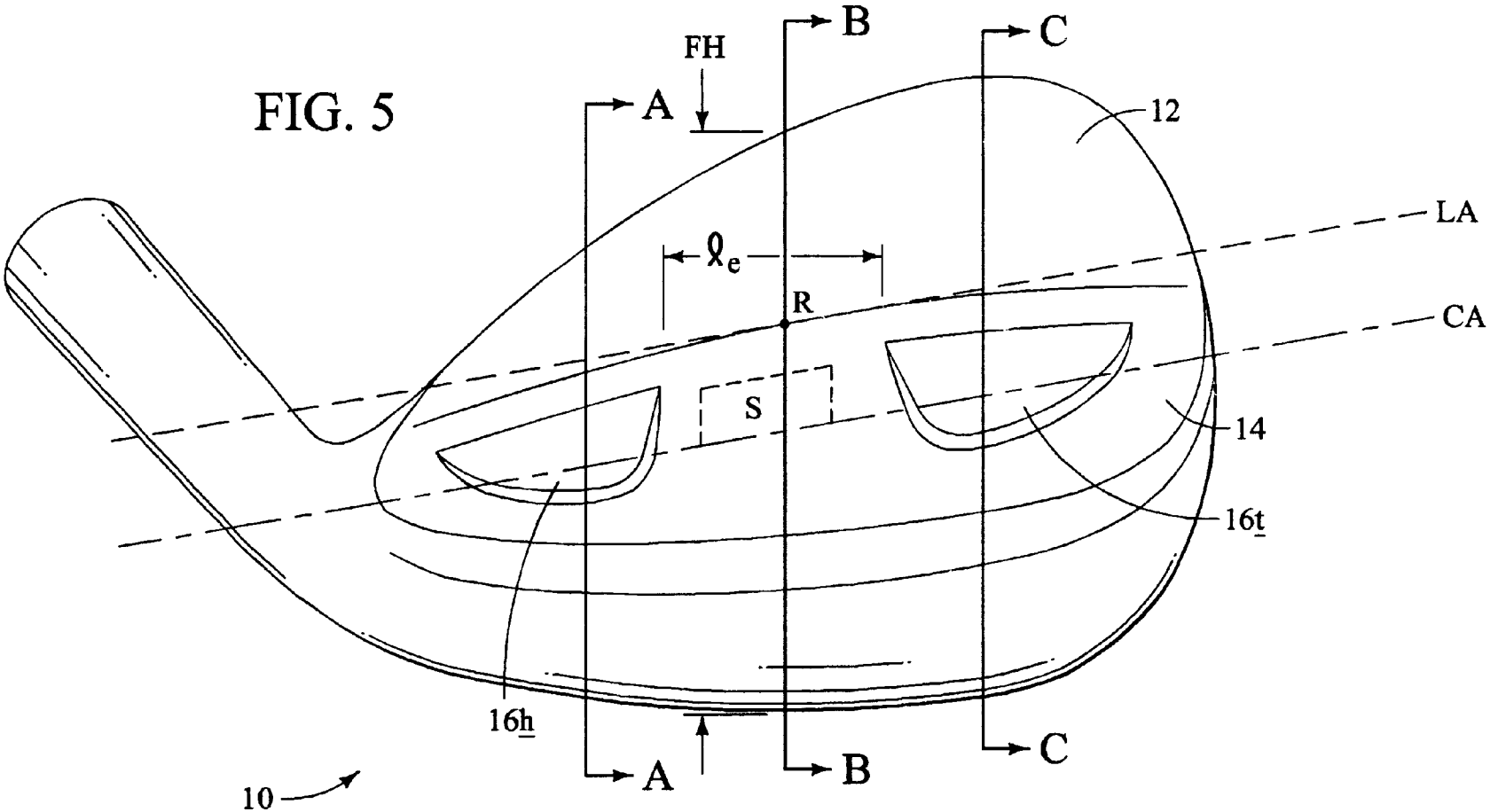
FIG. 5 is a rear plan view of the golf club head of FIG. 1, showing regions of enhanced flexibility and regions of increased stiffness.

As shown in FIG. 5, a stiffness zone S is located in a section of the central region that is defined in a vertical direction to extend from the central axis CA about midway to the lateral axis LA. In a substantially normal direction, the zone S preferably extends a distance of at least about 5%, and preferably about 10%, of the face length LF, measured from the face axis FA toward each of the toe and heel ends. As shown, the zone S is generally rectangular and it does not include any portion of either recess 16*t* or 16*h*. That is, the zone S exhibits increased stiffness relative to the upper portion 12.

Figure 10:
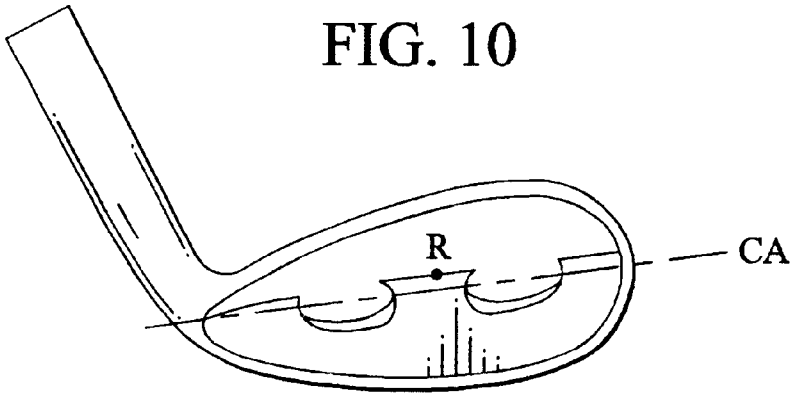
FIG. 10 is a rear elevational view of a further preferred golf club head of the present invention.
Figure 11:
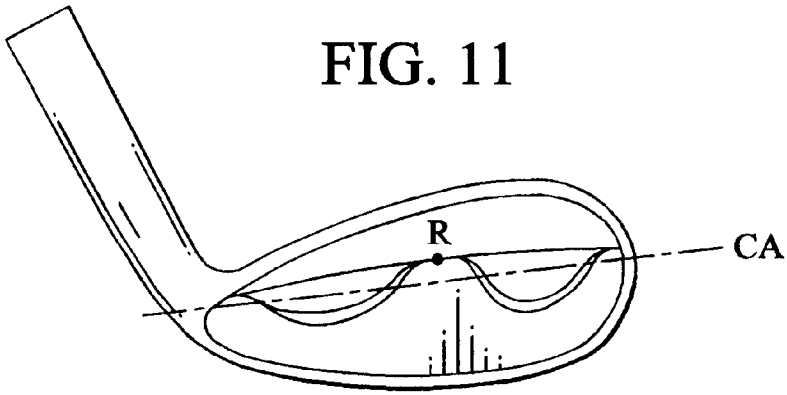
FIG. 11 is a rear elevational view of another preferred golf club head of the present invention.

Alternative embodiments may include having the top end of the central region with the reference point R curved above the zone S (see FIG. 11), or having the top end extend toward the toe and heel over the recesses 16*t* and 16*h* (see FIG. 10). In instances (not shown) where the lateral axis LA and central axis CA are co-linear, and the reference point R lies on the central axis CA, the lateral extent should be at least 10% of the length of the face LF, and preferably is at least 20% of the length of the face LF. The recesses should then extend below the central axis by a substantial majority of its total volume.

Figure 12:
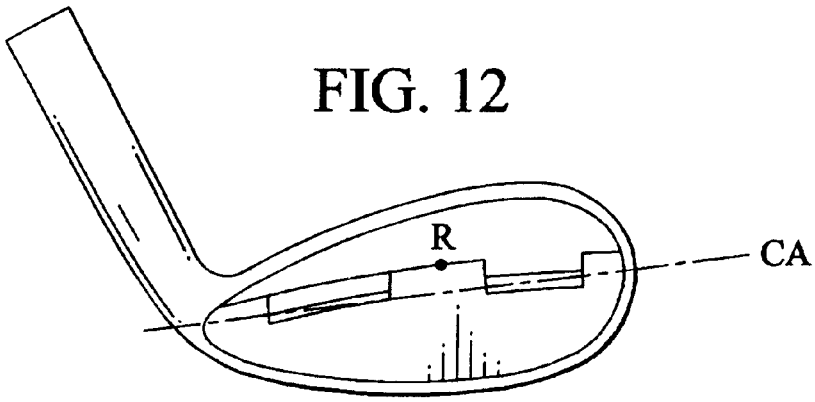
FIG. 12 is a rear elevational view of yet another preferred golf club head of the present invention.

The volume of the recesses 16*t* and 16*h* may be measured in terms of the material removed from an equivalent body without such recesses. In the present invention, the recesses extend downwardly from approximately the junction of the upper and lower portions to at least the central axis CA. Preferably, at least 10% of the volume of each of the toe and head recesses, and preferably 20%, is below the central axis. The shapes of the recesses may be varied from that depicted in FIGS. 4 and 5, such as rectangular (see FIG. 12), circular, triangular, or oval, etc.

Figure 5C:
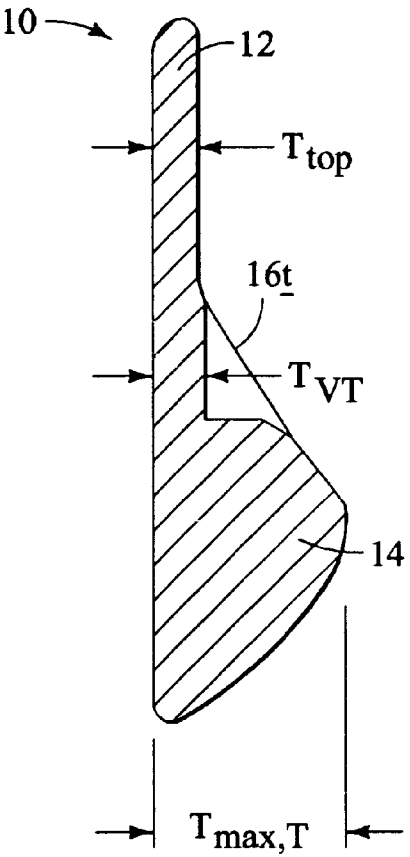
FIG. 5C is a cross-sectional view of the toe portion of the golf club head of FIG. 5, taken substantially in the direction of arrows C—C of FIG. 5.
Figure 5B:
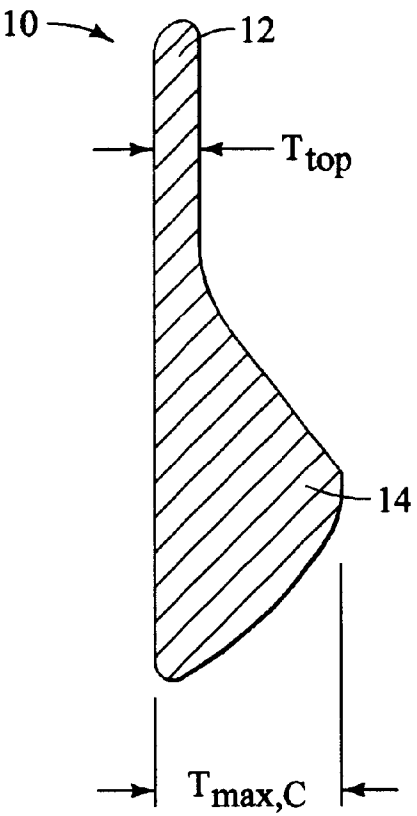
FIG. 5B is a cross-sectional view of the central portion of the golf club head of FIG. 5, taken substantially in the direction of arrows B—B of FIG. 5.
Figure 5A:
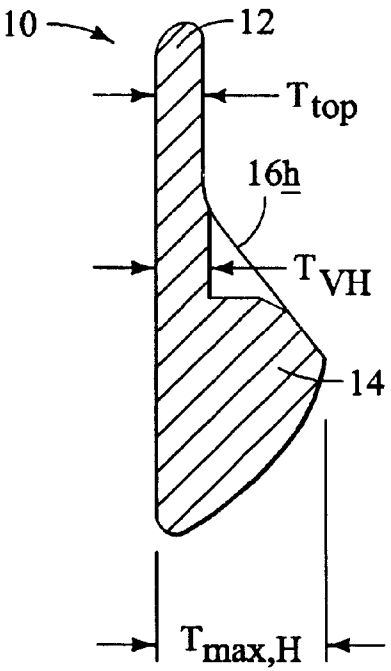
FIG. 5A is a cross-sectional view of the heel portion of the golf club head of FIG. 5, taken substantially in the direction of arrows A—A of FIG. 5.

Referring now to FIGS. 5A and 5C, a small stepped increase in thickness is present at the recesses 16*t* and 16*h* in this preferred embodiment. This thickness increase does not substantially increase the stiffness at the recesses, as compared to the stiffness at the upper portion 12. These recesses may be considered to be open toward the upper portion in that there is no wall bounding either recess at the junction of the club head's upper and lower portions, where the stepped increase occurs.

Elaborating now on the stiffness characteristics of the present invention, a point on a wall of the club head body may be considered beam-like in cross-section, and its bending stiffness at that point on the wall may be calculated as a cubed function of its thickness, $h^3$. That is, $EI=f(h^3)$, where E is the Young's Modulus and I is the inertia of the cross-section. Thus, for a body of uniform material, if a first point on the body has a thickness of 4 mm and a second point has a thickness of 4.5 mm, then the second point is 12.5% thicker and has a stiffness that is about 42% greater than that of the first point:

$$(4.5)^3/(4)^3=(1.125)^3=1.42$$

FIGS. 5A–5C show the change in thickness, and thus the change in stiffness, from top to bottom at the heel, central, and toe regions, respectively. A preferred material for the club head 10 of the present invention is steel, preferably a carbon steel, such as 8620. The thickness $T_{top}$ of the upper portion 12 of the club head preferably ranges from about 3 to 6 mm for irons and from about 3.5 to 5 mm for wedges. Most preferably, the thickness is 4 mm.

In the present invention the thickness of the front wall at the site of the recesses preferably is substantially the same as thickness of the upper portion 12 of the club head 10. In this first embodiment, the wall thickness of the respective heel and toe recesses, $T_{VH}$ and $T_{VT}$, is the same, preferably about 4.5 mm, which is about 13% greater than the top wall thickness $T_{top}$. Alternatively, the wall thickness of one or both recesses may be the same as the top wall thickness $T_{top}$. Neither recess should have a wall thickness that is more than about 13% greater than the top wall thickness $T_{top}$.

The remainder of the lower portion 14 of the club head should include a thickness increase of at least 15%, as compared to the top thickness $T_{top}$, which corresponds to a stiffness increase of more than 50%. Preferably, the thickness increases at least 25%, which corresponds to a stiffness increase of more than 95%.

In addition, a point of maximum thickness in the central region, $T_{max,C}$ (see FIG. 5B), should be at least 2.5 times thicker, i.e., about 16 times stiffer, than the top thickness $T_{top}$. Points of maximum thickness in the heel region, $T_{max,H}$, and in the toe region, $T_{max,T}$, should be at least two times thicker, i.e., eight times stiffer, than the top thickness $T_{top}$. Preferably, the central region is about 20 times stiffer, and the toe and heel regions are about 10 times stiffer, compared with the upper portion stiffness. More preferably, the central region is about four times thicker, and the toe and heel regions are 3.5 times thicker, corresponding to 64 and 43 times stiffer, respectively, compared to the upper portion 12. The preferred thickness values for this embodiment are shown in Table II.

TABLE II

First Preferred Embodiment Thickness/Stiffness Values

| REGION | UPPER PORTION $T_{TOP}$ | RECESS $T_{VT}$, $T_{VH}$ | TOE $T_{max,T}$ | CENTRAL $T_{max,C}$ | HEEL $T_{max,H}$ |
|---|---|---|---|---|---|
| Thickness (mm) | 4 | 4.5 | 16.7 | 16.9 | 14.6 |
| Relative Stiffness (T3) | 64 | 91.1 | 4691 | 4861 | 3087 |
| Δ Stiffness (%) | — | +42 | +7230 | +7495 | +4723 |

Alternative embodiments of the present invention are depicted in FIGS. 6–12. Common features are noted with common reference numerals or letters.

Figure 6:
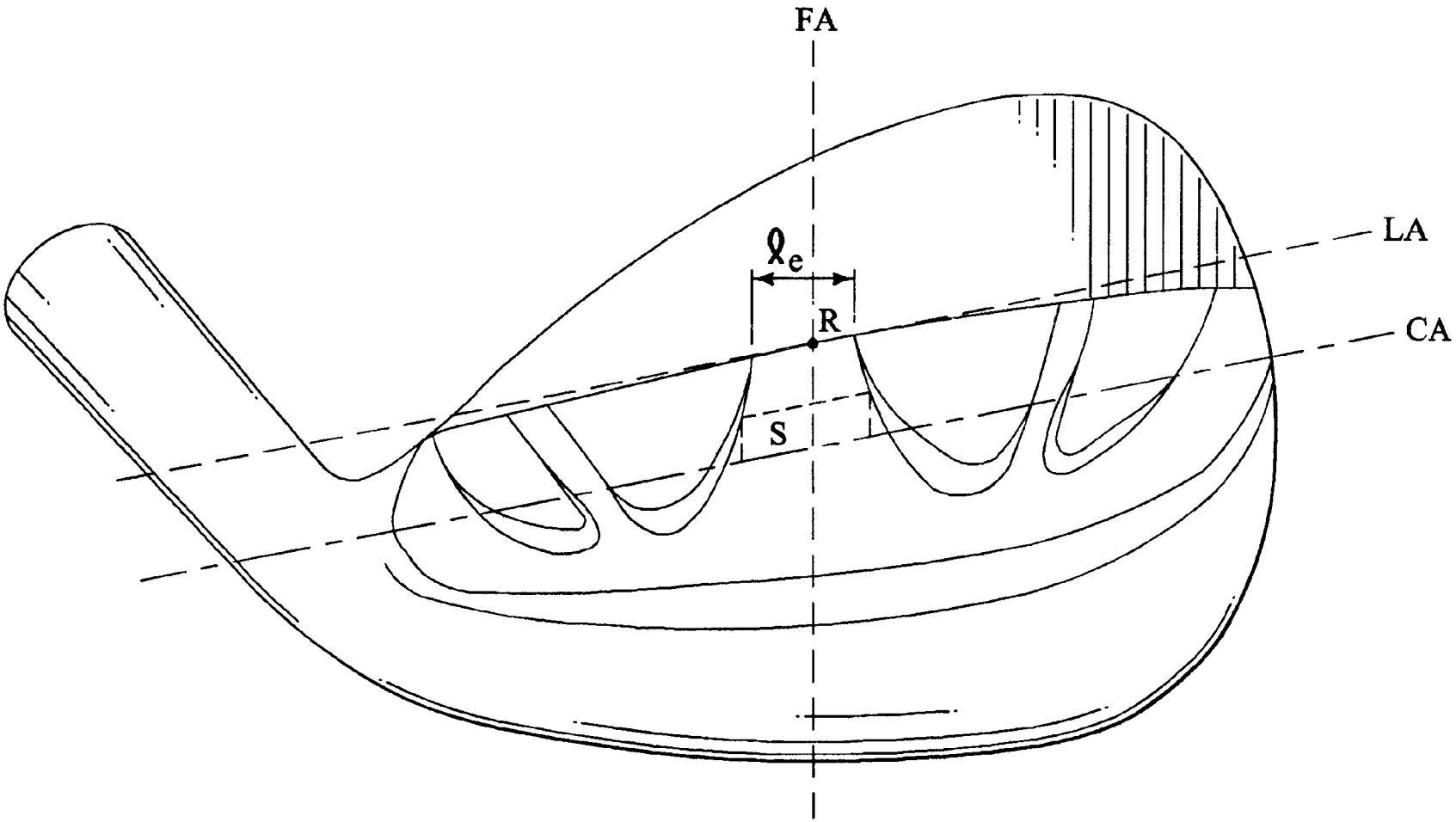
FIG. 6 is a rear plan view of a wedge-type golf club head of a second preferred embodiment, the head having regions of enhanced flexibility.

With reference to FIG. 6, multiple recesses are formed at the toe and heel regions. The overall lateral extent of the recesses is greater than in the embodiment of FIGS. 1–5, while the central region has a narrower lateral extent $l_e$ at the junction of the upper and lower portions.

Figure 9:
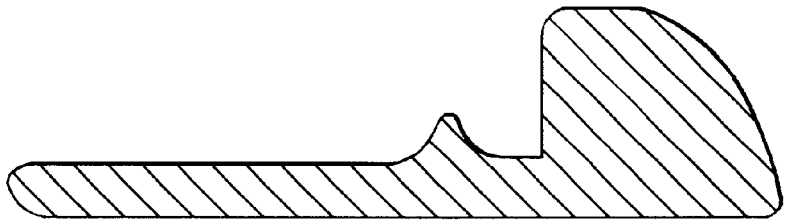
FIG. 9 is a cross-sectional view of the toe region of a seventh embodiment of a golf club head, similar to FIG. 5C.
Figure 7B:
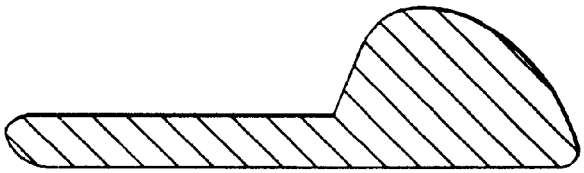
FIG. 7B is a cross-sectional view of the heel region of a fourth embodiment of a golf club head, similar to FIG. 5A.
Figure 7A:
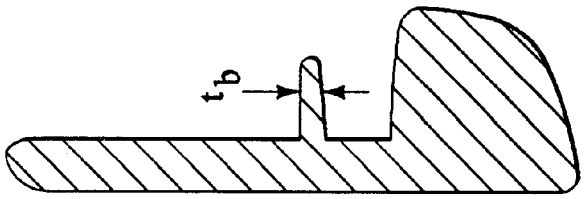
FIG. 7A is a cross-sectional view of the heel region of a third embodiment of a golf club head, similar to FIG. 5A.

FIGS. 7A and 7B depict closed and open recesses, respectively, at the heel region. In addition, sole surfaces and lower side walls forming the heel recess are shown in alternative configurations. The thin upper bounding wall of FIG. 7A has a thickness $t_b$ that does not substantially disrupt the stiffness values of points along the front wall extending from the top edge to the lower side wall of the recess. FIG. 9 depicts an alternative closed toe recess, comparable in nature to the closed heel recess of FIG. 7A.

Figure 8B:
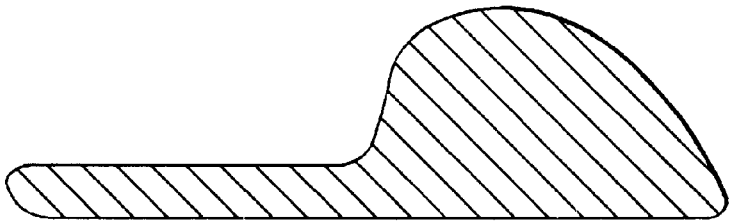
FIG. 8B is a cross-sectional view the central region of a sixth embodiment of a golf club head, similar to FIG. 5B.
Figure 8A:
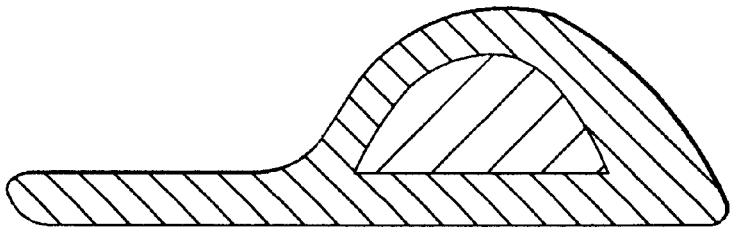
FIG. 8A is a cross-sectional view of the central region of a fifth embodiment of a golf club head, similar to FIG. 5B.

FIGS. 8A and 8B depict central regions having alternative rear and sole surfaces. In addition, FIG. 8A depicts a cavity within a shell formed in the central region, wherein a second material is used in lieu of the material of the remainder of the club head body. The cavity and shell may be cast, for example, and the second material may be injected or inserted through one or more openings (not shown) in the sole or a side wail of a recess. Any suitable material providing the appropriate stiffness in conjunction with the outer shell may be used within the central region.

The embodiments described in detail above are merely illustrative, and the present invention may be readily embodied using alternative materials, such as composites, in lieu of metals or their alloys, as well as in hybrid constructions utilizing, for example, laminations of metal and composite materials. The face plate may be a separate portion that is welded or otherwise attached to the front of the club head in a manner known to those skilled in the art. The lower rear portion may comprise one or more separately formed pieces that are attached to the front in any manner known to those skilled in the art.

Although the invention has been disclosed in detail with reference only to the preferred embodiments, those skilled in the art will appreciate that alternative golf club heads can be made without departing from the scope of the invention. Accordingly, the invention is defined only by the claims set forth below.

We claim:

1. A golf club head comprising:

a body having a planar upper portion, said upper portion having a top edge and a substantially constant thickness, and a rearwardly extending lower portion, said lower portion having a bottom edge, wherein a front surface of said lower portion and a front surface of said upper portion together form a substantially planar striking face having a loft angle measured from a vertical axis, said striking face having a length, and wherein a rear side of said lower portion having at least a first recess adjacent a toe end and at least a second recess adjacent a heel end;

wherein a lateral axis at the junction of said upper and lower portions of said body extends from said toe end to said heel end, with a reference point being defined at a mid portion of said lateral axis, between about 50% and about 75% of the height of the striking face, measured from said bottom edge to said top edge, said reference point being located less than about 70% of the face height if said loft angle is less than about 56 degrees, and wherein a central axis is defined substantially parallel to said lateral axis, at approximately 50% of the face height;

wherein said first recess comprises a first volume and said second recess comprises a second volume, said first and second recesses extending downwardly at least to said central axis, and wherein the portions of the body that define said first and second recesses each have a stifffiess approximately the same as the stiffness of said upper portion, while the remainder of said lower portion has a stiffness at least 50% greater than the stiffness of said upper portion;

wherein a central region of said lower portion, located below said reference point, has a maximum stiffness that is at least about 20 times the stiffness of said upper portion, and wherein regions located below said first and second recesses each have a maximum stiffness at least about 10 times the stiffness of said upper portion, wherein a stiffness zone is located within said central region, at said central axis and extending halfway toward said lateral axis, between said first and second recesses, at least about 10% of the length of said striking face, such that a relative stiffness is established between said central region and said upper portion and between said central region and said first and second recesses.

2. The golf club head of claim 1, wherein said region below said first recess has a maximum stiffness at least about 20 times greater than the stiffness of said upper portion.

3. The golf club head of claim 1, wherein said lower portion comprises at least two recesses located adjacent said toe and at least one recess located adjacent said heel.

4. The golf club head of claim 1, wherein said first and second recesses are open in directions toward said upper portion.

5. The golf club head of claim 1, wherein said first and second recesses are closed in directions toward said upper portion.

6. The golf club head of claim 1, wherein a central region of said lower portion located below said reference point is solid.

7. The golf club head of claim 1, wherein:

a central region of said lower portion of said body, located below said reference point, is hollow; and said golf club head further comprises a material disposed within the hollow central region that is different from the material of said body of said golf club head.

8. The golf club head of claim 7, wherein the material disposed within the hollow central region has a different density from the density of said body of said golf club head.

9. The golf club head of claim 1, wherein said central region has a length measured along said lateral axis above said stiffness zone that is between about 5 and about 45% of the length of said striking face.

10. The golf club head of claim 9, wherein said length of said central region is between 20 and 40% of the length of said striking face.

11. The golf club head of claim 9, wherein at least 10% of each of said first and second volumes is located below said central axis.

12. The golf club head of claim 1, wherein a toe region of said lower portion of said body, located adjacent to said first recess, has a stiffness at least 95% greater than the stiffness of said upper portion.

13. The golf club head of claim 12, wherein a heel region of said lower portion of said body, located adjacent to said second recess, has a stiffness at least 95% greater than the stiffness of said upper portion.

14. The golf club head of claim 12, wherein said region below said first recess has a maximum stiffness at least 20 times the stiffness of said upper portion.

15. The golf club head of claim 12, wherein at least 20% of each of said first and second volumes is located below said central axis.

16. A golf club head comprising:

a body having a planar upper portion, said upper portion having a top edge and a substantially constant thickness, and a rearwardly extending lower portion, said lower portion having a bottom edge, wherein a front surface of said lower portion and a front surface of said upper portion together form a substantially planar striking face having a loft angle measured from a vertical axis, said striking face having a length, and wherein a rear side of said lower portion having at least a first recess adjacent a toe end and at least a second recess adjacent a heel end;

wherein a lateral axis at the junction of said upper and lower portions of said body extends from said toe end to said heel end, with a reference point being defined at a mid portion of said lateral axis, between about 50% and about 75% of the height of the striking face, measured from said bottom edge to said top edge, said reference point being located less than about 70% of the face height if said loft angle is less than about 56 degrees, and wherein a central axis is defined substantially parallel to said lateral axis, at approximately 50% of the face height;

wherein said first recess comprises a first volume and said second recess comprises a second volume, said first and second recesses extending downwardly at least to said central axis, and wherein the portions of the body that define said first and second recesses each have a thickness approximately the same as the thickness of said upper portion, while the remainder of said lower portion has a thickness at least 25% greater than the thickness of said upper portion, wherein a first rib is located at said toe end of the rear of said lower portion, extending below said first recess, and a second rib is located at said heel end of the rear of said lower portion, extending below said second recess;

and wherein a central region of said lower portion, located below said reference point, has a maximum thickness that is at least about 2.5 times the thickness of said upper portion, and wherein regions located below said first and second recesses each have a maximum thickness at least about 2 times the thickness of said upper portion, wherein a stiffness zone is located within said central region, at said central axis and extending halfway toward said lateral axis, between said first and second recesses, at least about 10% of the length of said striking face, such that a relative stiffness is established between said central region and said upper portion and between said central region and said first and second recesses.

17. The golf club head of claim 16, wherein the thickness of said upper portion is between about 3 mm and about 6 mm.

18. The golf club head of claim 17, wherein the thickness of said upper portion is between about 3.5 mm and about 5 mm.

19. The golf club head of claim 18, wherein the thickness of said upper portion is about 4 mm.

20. The golf club head of claim 16, wherein said junction of said upper and lower portions is curved and said lateral axis is tangential to said junction at said reference point.

21. A golf club head comprising:

a body having a planar upper portion, said upper portion having a top edge and a substantially constant thickness, and a rearwardly extending lower portion, said lower portion having a bottom edge, wherein a front surface of said lower portion and a front surface of said upper portion together form a substantially planar striking face having a loft angle measured from a vertical axis, said striking face having a length, and wherein a rear side of said lower portion having at least a first recess adjacent a toe end and at least a second recess adjacent a heel end;

wherein a lateral axis at the junction of said upper and lower portions of said body extends from said toe end to said heel end, with a reference point being defined at a mid portion of said lateral axis, said reference point being located less than about 75% of the face height, measured from said bottom edge to said top edge, wherein a central axis is defined substantially parallel to said lateral axis, at approximately 50% of the face height;

wherein said first recess comprises a first volume and said second recess comprises a second volume, said first and second recesses extending downwardly at least to said central axis, and wherein the portions of the body that define said first and second recesses each having a stiffness approximately the same as the stiffness of said upper portion, while the remainder of said lower portion has a stiffness at least 50% greater than the stiffness of said upper portion;

wherein the lower portion of said body defines a first rib, said first rib having an upper end located at said toe end of the rear of said lower portion and extending below said first recess, and a second rib, said second rib having an upper end located at said heel end of the rear of said lower portion and extending below said second recess, the upper ends of said first and second ribs extending at least to said central axis;

wherein a central region of said lower portion, located below said reference point, has a maximum stiffness that is at least about 20 times the stiffness of said upper portion, and wherein regions, located below said first and second recesses each have a maximum stiffness at least about 10 times the stiffness of said upper portion, wherein a stiffiess zone is located within said central region, at said central axis and extending halfway toward said lateral axis, between said first and second recesses, at least about 10% of the length of said striking face, such that a relative stiffness is established between said central region and said upper portion and between said central region and said first and second recesses.

22. The golf club head of claim 21, wherein the upper end of said first rib extends to said lateral axis.

23. The golf club head of claim 22, wherein the upper end of said first rib extends to about 80% of the face height.

* * * * *